US006973790B2

(12) United States Patent
Suenaga et al.

(10) Patent No.: US 6,973,790 B2
(45) Date of Patent: Dec. 13, 2005

(54) GAS TURBINE COMBUSTOR, GAS TURBINE, AND JET ENGINE

(75) Inventors: Kiyoshi Suenaga, Takasago (JP); Shigemi Mandai, Takasago (JP); Masaki Ono, Takasago (JP); Katsunori Tanaka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 55 days.

(21) Appl. No.: 10/464,499

(22) Filed: Jun. 19, 2003

(65) Prior Publication Data

US 2003/0233831 A1 Dec. 25, 2003

Related U.S. Application Data

(63) Continuation-in-part of application No. 10/001,804, filed on Dec. 5, 2001, now Pat. No. 6,640,544.

(30) Foreign Application Priority Data

Dec. 6, 2000 (JP) ..... P2000-371312

(51) Int. Cl.[7] ..... F02C 7/24

(52) U.S. Cl. ..... 60/725; 181/213

(58) Field of Search ..... 60/725; 181/213, 181/220, 222; 431/114

(56) References Cited

U.S. PATENT DOCUMENTS

| | | | | |
|---|---|---|---|---|
| 4,036,324 | A * | 7/1977 | Washbourne | 181/252 |
| 4,135,603 | A | 1/1979 | Dean, III et al. | |
| 6,530,221 | B1 * | 3/2003 | Sattinger et al. | 60/725 |
| 6,640,544 | B2 * | 11/2003 | Suenaga et al. | 60/725 |

FOREIGN PATENT DOCUMENTS

| | | |
|---|---|---|
| EP | 0 576 717 | 1/1994 |
| EP | 0 892 216 | 1/1999 |
| EP | 0 985 882 | 3/2000 |
| EP | 0 990 851 | 4/2000 |
| JP | 6-147485 | 5/1994 |
| JP | 6-173711 | 6/1994 |
| JP | 7-280270 | 10/1995 |
| JP | 11-141878 | 5/1999 |
| JP | 2000-265856 | 9/2000 |

OTHER PUBLICATIONS

McGraw-Hill Encyclopedia of Science & Technology, 7th Edition, 1992, p. 616.

* cited by examiner

*Primary Examiner*—Louis J. Casaregola
(74) *Attorney, Agent, or Firm*—Oblon, Spivak, McClelland, Maier & Neustadt, P.C.

(57) ABSTRACT

For the purpose of reduced NOx gas emission, a gas turbine engine comprises a cylinder having a combustion region inside of the cylinder; a resonator having a cavity and provided around the surface of the cylinder and sound absorption holes formed on the cylinder and having opening ends on the cylinder.

18 Claims, 8 Drawing Sheets

GAS TURBINE COMBUSTOR, GAS TURBINE, AND JET ENGINE

BACKGROUND OF THE INVENTION

1. Field of the Invention

The present invention relates to a gas turbine combustor which can reduce the oscillations due to combustion, a gas turbine, and a jet engine which is provided with this combustor.

2. Description of Related Art

For gas turbines which output shaft power by compressing air as a working fluid and heating it in a combustor, and expanding the thus produced high temperature and high pressure gas in a turbine, and for also jet engines used to directly propel aircraft by the kinetic energy produced by the output of a high speed jet in recent years, there has been demand for a reduction in emissions such as nitrogen oxides (NOx) from the environmental viewpoint.

These gas turbines and jet engines have a compressor, a combustor, and a turbine as their principle components, and the compressor and the turbine are directly connected to each other by a main shaft. The combustor is connected to the outlet port of the compressor, and the working fluid which is discharged by the compressor is heated by the combustor to a predetermined turbine entrance temperature. The high temperature and high pressure working fluid provided to the turbine, in the main casing, passes between the static blades and the dynamic blades attached to the main shaft, and expands, which rotates the main shaft and provides output power. In the case of a gas turbine, the shaft power can be obtained by subtracting the power consumed by the compressor from the total output power, and, the shaft power can be used as a driving source if an electric generator or the like is connected to one end of the main shaft.

In order to reduce emissions, such as NOx and the like, from gas turbines and jet engines, a variety of research and development projects concerning combustors are being carried out. For premixing type combustors, it is known that NOx emissions can be effectively reduced when mixture of the fuel gas and the air is homogeneous. In contrast, when the mixture is not homogeneous, because local high temperature portions occur in the high concentration regions of the flame, large quantities of NOx are generated in the high temperature regions and the total emission of the combustor increase. The invention of Japanese Unexamined Patent application, First publication No. Hei 11-141878 is one prior art disclosing a solution to the problem of an inhomogeneous mixture. This prior art discloses a gas turbine combustor provided with a vane provided with a plurality of small holes at the air inflow side of the combustor to distribute the inflowing air and provide a uniformly mixed gas.

This gas turbine combustor is explained as an example of a conventional gas turbine with reference to FIG. 8 and FIG. 9. In FIG. 8 and FIG. 9, reference numeral 1 is a combustor, reference numeral 2 is an inner cylinder, reference numeral 3 is a premixing nozzle, reference numeral 4 is a pilot burner, reference numeral 5 is a main burner, and reference numeral 6 is a top hat. Between the inner cylinder 2 and the top hat 6, air path 7 is formed for the air flow provided by the combustor.

The air flow provided by the combustor flows into the entrance for the air path 7 after being reversed by nearly 180 degrees as shown in the arrow in the drawing, and is reversed by 180 degrees again at the exit, and flows into the combustor 1. Near the exit or inlet of the air corridor 7, the porous plate 8 provided with a plurality of holes 8*a* are provided. FIG. 8 shows the example for the porous plate set at the exit.

Accordingly, the flow of air which has passed the vane 8 is homogeneous in cross section, and is provided to the tip of the pilot burner which constitutes the premixing nozzle 3, and to the tip of the main burner 5; therefore premixed air, having a homogeneous fuel gas concentration, is produced, and a reduction in NOx formation can be achieved.

However, the above conventional gas turbine combustor, gas turbine, and jet engine have the following problems. While the combustion of premixed air having a uniform concentration has the advantage of reduced NOx emissions, in contrast, a problem is that the combustion oscillations may occur because of the increase of generated heat per unit volume because the combustion occurs in a restricted area in a short period of time.

Such combustion oscillations propagate as pressure waves, and may resonate with parts which can form acoustic systems such as a casing of a combustor or a gas turbine, and because there is the concern that the internal pressure fluctuations of the combustor may become large, normal operation of the gas turbine and the jet engine is difficult under such conditions.

Also, the turbulence of the air flow provided by the compressor is strong and not readily attenuated, therefore, the combustion tends to be unstable. This instability in the combustion may also give rise to pressure waves in the internal pressure fluctuations in the combustor, these pressure waves may propagate, and may resonate with parts which can form an acoustic system such as a casing of a combustor or a gas turbine in some conditions. Accordingly, there is the concern that the internal pressure fluctuations of the combustor may become large, and normal operation of the gas turbine and the jet engine is difficult under such conditions.

Japanese Unexamined Patent application, First publication No. Hei 6-147485 discloses a gas turbine combustor for burning fuel in lean-burn condition wherein an cylinder of combustor is surrounded by a porous wall-cylinder having a cavity between the internal cylinder and the wall cylinder. In this type of gas turbine combustor, however, the porous wall-cylinder is disposed so as not to intervene plate-fins which are the combustion region, therefore decreasing effect of combustion oscillation has not been achieved sufficiently.

The present invention was made in consideration of the above points, and aims to reduce the combustion oscillations while maintaining a low level of NOx emissions from the gas turbine combustor, and also has the objective of providing a jet engine which operates stably.

SUMMARY OF THE INVENTION

In order to achieve above objects, present invention comprises the following constitutions.

The gas turbine combustor according to the first aspect of present invention comprises a cylinder having an internal combustion region, a resonator having a cavity is provided around the periphery of the cylinder, and sound absorption holes are formed opening into the cavity.

Accordingly, in the gas turbine combustor of present invention, because the air which is made to oscillate by the combustion oscillations resonates with the air in the sound absorption holes and the cylinder. As a result, the combustion oscillations are attenuated and their amplitude is decreased, and the pressure fluctuations due to the combustion oscillations can be controlled.

According to the second aspect of present invention, the resonator and the sound absorption holes oscillate according to the resonance frequency of the cylinder.

Therefore, the combustion oscillations occurring in the cylinder can be controlled effectively in the gas turbine combustor of present invention.

According to the third aspect of present invention, the resonator and the sound absorption holes are disposed near the combustion region.

Therefore, in the gas turbine combustor of present invention, the pressure fluctuations can be more effectively controlled by controlling the oscillations in an area near the combustion region where the combustion oscillations are relatively large.

According to the fourth aspect of present invention, a plurality of fluid distribution grooves are provided at intervals on the cylinder, and the sound absorption holes are formed in the intervals between the fluid distribution grooves.

Therefore, in the gas turbine combustor of present invention, the combustion oscillations can be controlled as cylinder is cooled by the distribution of the fluid. Also, this construction enables the gas turbine combustor to prevent the combustion oscillation without deteriorating the cooling effect on the cylinder.

According to the fifth aspect of present invention, a resistive member is provided in the cavity of the resonator.

According to the sixth aspect of present invention, the resistive member is formed around the periphery of the cylinder in which the sound absorption holes are formed.

Therefore, in the gas turbine combustor of present invention, by taking into consideration the resistive member when designing the acoustic resonator, and selecting the optimal resistive member, the friction loss occurring in the resistive member is added to the friction loss of the sound absorption holes, and it is possible to reduce the combustion oscillations even more effectively.

The gas turbine combustor according to the seventh aspect of present invention comprises a compressor which compresses air and provides an air flow, a gas turbine combustor according to one of the first to sixth aspects of the invention, and a turbine which outputs shaft power by rotating due to the expansion of high temperature high pressure gas provided by the gas turbine combustor.

In the gas turbine of the present invention, by applying the above combustor, the combustion oscillations can be reduced. As a result, it is possible to prevent resonances in members which can form an acoustic system, such as the casing of a combustor or a gas turbine.

The jet engine according to the eighth aspect of present invention comprises a compressor which compresses air and provide an airflow, a gas turbine according to one of the first to the sixth aspects of the invention, and a turbine to which high temperature high pressure gas is provided by the gas turbine combustor.

Therefore, in the jet engine of present invention, by applying the above combustor, the combustion oscillations can be reduced. As a result, it is possible to prevent resonances in members which can form an acoustic system, such as a combustor or a gas turbine.

DETAILED DESCRIPTION OF THE INVENTION

The first embodiment of gas turbine combustor, gas turbine, and jet engine in present invention is explained as follows.

This type of gas turbine and the jet engine mainly comprise a compressor, a combustor, and the turbine as described for the prior art. The gas turbine rotates the main spindle by expanding the high temperature high pressure gas in the turbine, and generates the shaft output which is used as a driving force for a equipment such as an electric generator. The jet engine rotates the main spindle by expanding the high temperature high pressure gas in the turbine, and exhausts a high speed jet (discharge air) to provide kinetic energy which is used as a driving force of an aircraft from the exit of the turbine.

Among the components of above structure, the compressor introduces and compresses the air as working fluid, and supplies the air flow to the combustor. In this compressor, an axial flow compressor which is combined with the turbine via the main spindle is used, the axial flow compressor compresses the air (the atmosphere) suctioned in from an inlet, and supplies the air to the combustor which is connected to the outlet of the compressor. This air flow bums the fuel gas in the combustor, thus the high temperature high pressure gas generated in this way is supplied to the turbine.

Figure 1:
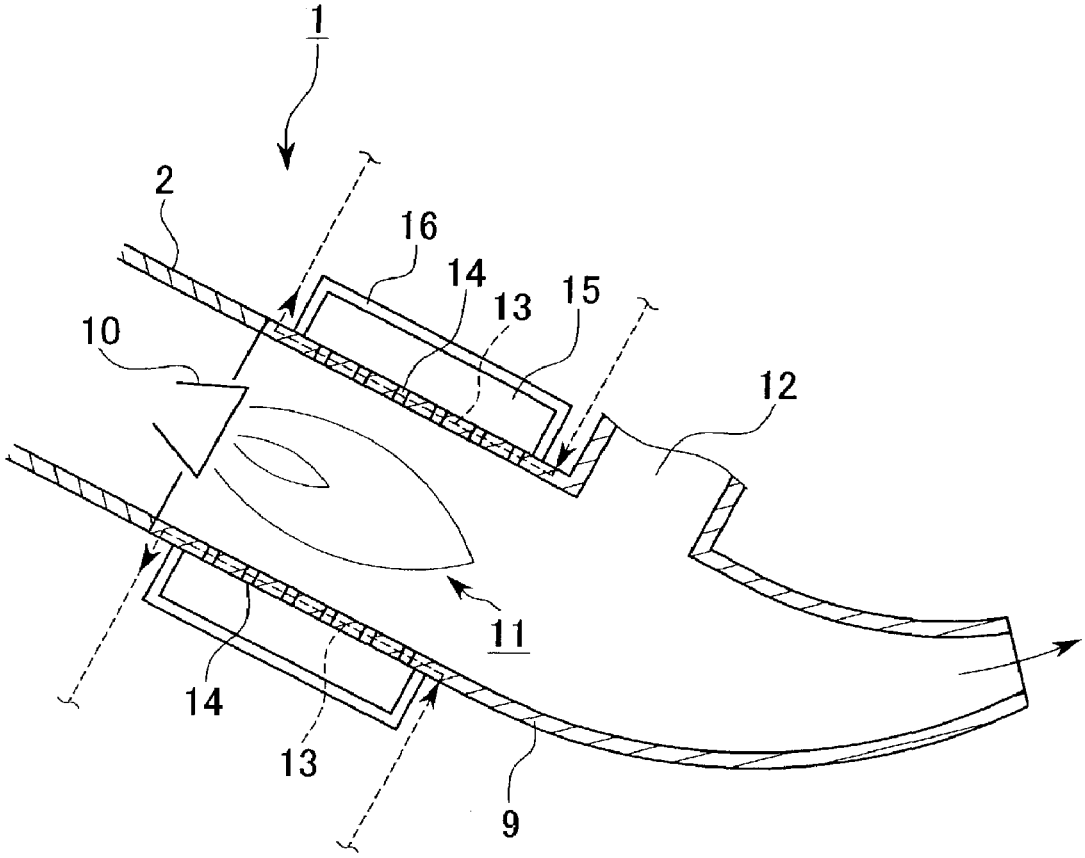
FIG. 1 is a cross section showing sound absorption holes and the acoustic liner in the cylinder tail of the first embodiment of present invention.

FIGS. 1 and 2 show the gas turbine combustor. In these drawings, for the purpose of simplifying the explanation, the same reference numerals are used for the elements which are the same as those of the prior art in FIGS. 8 and 9. In FIG. 1, the reference numeral 2 is an inner cylinder, and the reference numeral 9 is a cylinder tail.

A burner 10 is provided in the inner cylinder 2. In the cylinder tail 9, combustion region 11 is formed in the downstream of the burner 10. The fuel gas which is a mixture of compressed air and the fuel burns in this combustion region. The cylinder tail 9 introduces the combustion gas generated in the combustion region to the turbine (not shown in the drawing). The tip of downstream of cylinder tail 9 curves towards the turbine (not shown in the drawing). The cross section of the tip of downstream of cylinder tail 9 has a shape such that the radius of the curvature gradually becomes smaller from the middle section of the cylinder tail 9 towards its tip. Also, a by-pass 12 is connected to the cylinder tail for the purpose of adjusting the density of the combustion gas by introducing air.

Figure 2A:
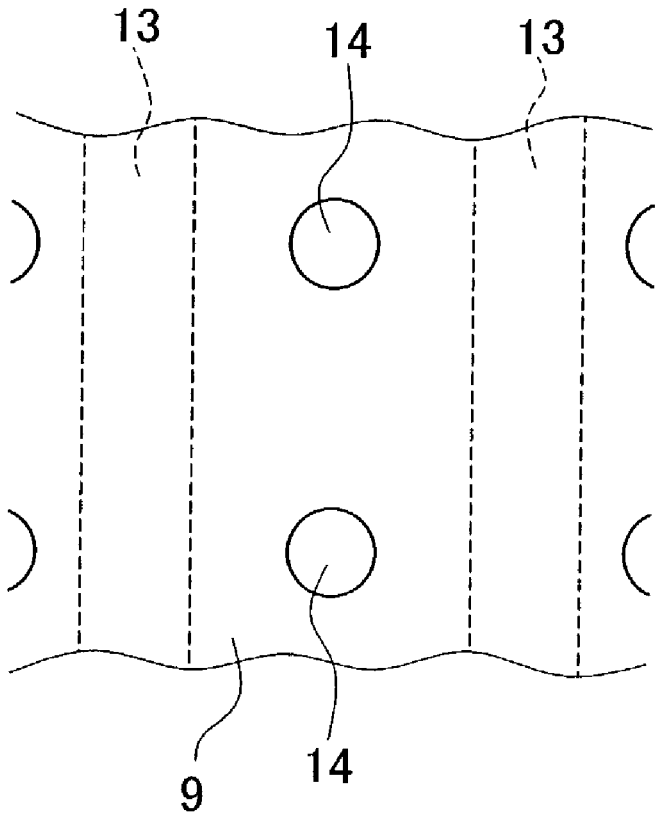
FIG. 2A is a plan view showing fluid grooves and sound absorption holes in the cylinder tail.
Figure 2B:
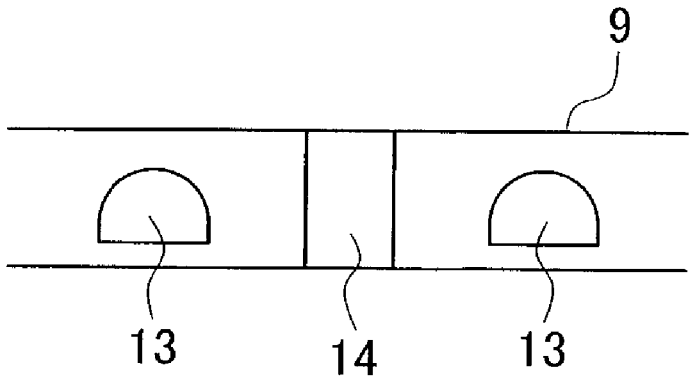
FIG. 2B is a cross section showing fluid grooves and sound absorption holes in the cylinder tail.

A cooling groove (fluid groove) 13 is formed on the wall of the cylinder tail 9 along the axial direction (direction of the gas flow), through which cooling vapor (fluid) flows. As shown in FIG. 2A, a plurality of cooling grooves 13 are formed at intervals in the peripheral direction. As shown in FIG. 2B, the cross section of the cooling groove 13 is semicircular. In addition, the vapor supplied from a boiler (not shown in the drawing) flows in the cooling grove 13 to cool the cylinder tail 9.

Also, a plurality of sound absorption holes 14 are formed near the combustion region 11, or near the fire in the cylinder tail 9. These sound absorption holes 14 are formed between the cooling grooves 13. The sound absorption holes 14 and the cooling grooves are disposed at an appropriate distance. Furthermore, the acoustic liner (resonator) 16 is provided on all around the cylinder tail 9. The acoustic liner works as a damper which forms cavities 15 near the combustion region 11, and between the combustion region 11 and the cylinder tail 9. The above sound absorption holes 14 opens into the ends of the cavities 15.

The oscillation characteristics such as the diameter of the sound absorption holes 14 (sectional area) and the size of the acoustic liner 16 (capacity of cavities 15) is determined according to the natural frequency of resonance of the combustor. In this case, the natural frequency of resonance of the combustor is determined in advance according to factors such as temperature, pressure, velocity of flow of the combustion gas, and shape of the cylinder tail 9. Therefore, the gas turbine can be operated favorably for various shapes of combustor and various conditions of combustion by tuning acoustically the oscillation characteristics of the sound absorption holes 14 and acoustic liner 16.

The oscillation reducing operation of above gas turbine combustor is explained as follows. When combustion oscillation occur during the combustion of fuel gas in the downstream part of the burner 10, oscillation of the air oscillation (pressure waves) due to combustion oscillations in the cylinder tail 9 are caught by the sound absorption holes 14, thus resonance occurs. More exactly, the air in the sound absorption holes 14 and the air in the cavities 15 constitute a resonance system. Because air in the cavities 15 functions as a spring, the air in the sound absorption holes 14 oscillates (resonates) strongly at the resonance frequency of this resonance system, and the sound at the resonance frequency is absorbed by friction. Thus the amplitude of the combustion oscillation can be lowered.

As explained above, in the gas turbine combustor of present embodiment, because the air in the acoustic liner 16 and the air in the sound absorption holes 14 resonate with the combustion oscillation, the combustion oscillation can be lowered. Thus operation with reduced NOx emissions and the prevention of the resonance with the acoustic system, can be achieved compatibly. Particularly in present embodiment, the sound absorption holes 14 and the acoustic liner 16 are disposed near the flame in the combustion region 11, and the combustion oscillation can be absorbed effectively. In addition, because the acoustic liner 16 is provided around the periphery of the cylinder tail 9, the transmission of the combustion oscillation via the cylinder tail 9 can be prevented. Also in present embodiment, the sound absorption holes 14 are formed between the cooling grooves 13, and combustion oscillation can be prevented without causing any deterioration of the cooling effect on the cylinder tail 9.

Also, due to the reduced possibility of the combustion oscillation, resonance of the combustor and the casing caused by the combustion oscillation can be prevented, thus, as a result, stable operation is possible in gas turbines and the jet engines provided with the above combustion equipment.

Figure 3:
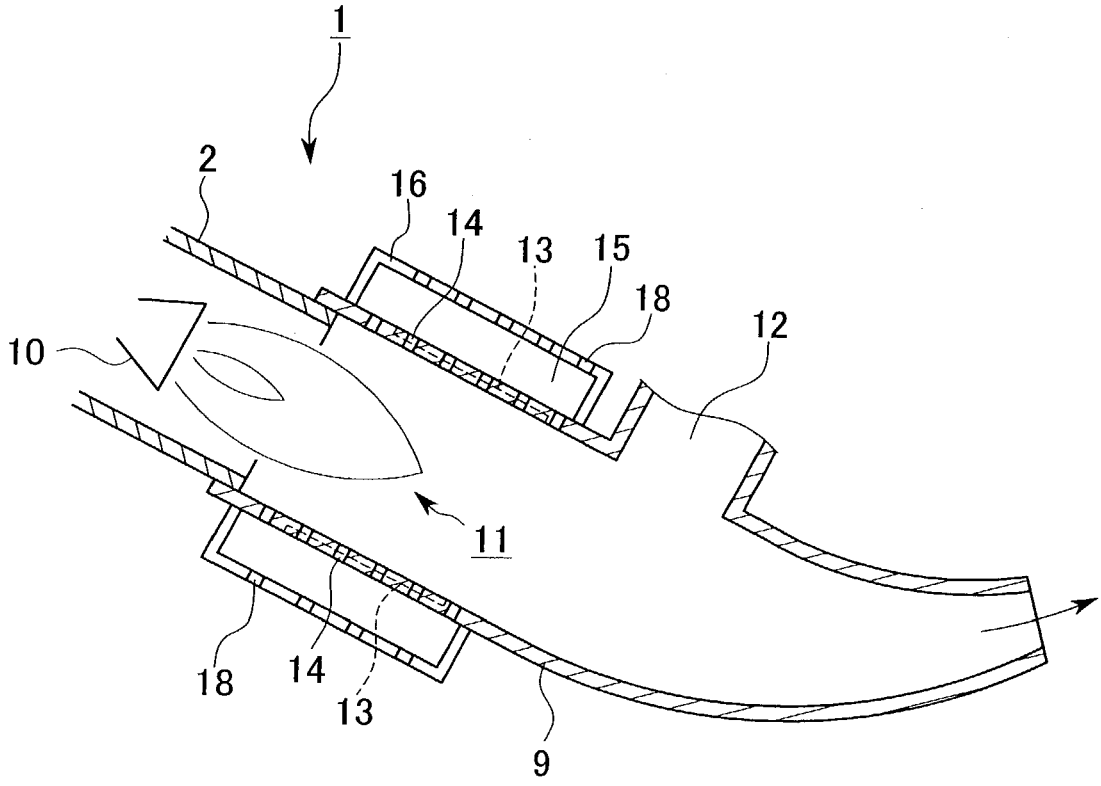
FIG. 3 is a cross section showing sound absorption holes and the acoustic liner in the cylinder tail of the second embodiment of present invention.

FIGS. 3 and 4 show the second embodiment of the gas turbine combustor of present invention. In these drawings, the same reference numerals are used for elements which are the same as those of the first embodiment in FIGS. 1 and 2. The second embodiment differs from the first embodiment in that the cooling operation is not carried out with vapor but with air.

Figure 4A:
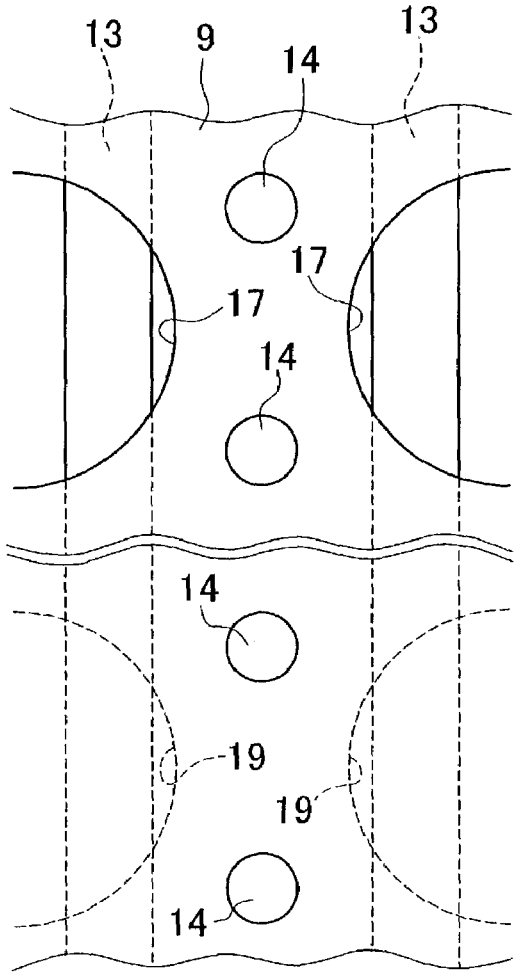
FIG. 4A is a plan view showing fluid grooves and sound absorption holes in the cylinder tail.
Figure 4B:
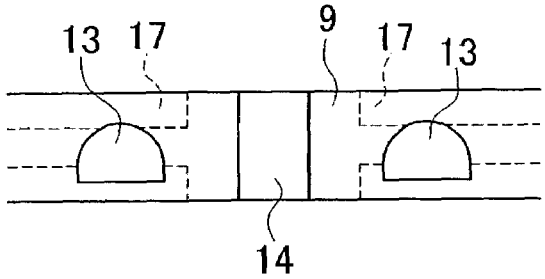
FIG. 4B is a cross section showing fluid grooves and sound absorption holes in the cylinder tail.

Also shown in FIG. 3, in the second embodiment, the burner 10 and combustion region 11 are disposed further to upstream than in the case of the first embodiment. The sound absorption holes 14 and the acoustic liner 16 are disposed near the combustion region 11. Also, as shown in FIG. 4A, a plurality of cooling groove 13 are formed on the cylinder tail 9 along the direction of the gas flow, at intervals in the peripheral direction. On the external surface of the cylinder 9, the cooling hole 17 which communicates with the cooling groove 13 and the cavities 15 is formed upstream of the cooling groove 13. On the internal surface of the cylinder tail 9, the cooling hole 19 which communicates with the inside of the cylinder tail and the cooling groove 13 is formed downstream of the cooling groove 13. As shown in FIG. 4B, the sound absorption holes 14 are disposed in the intervals between the cooling grooves 13, and also between the cooling holes 17 and 19.

As shown in FIG. 3, a plurality of cooling holes 18 which combine the cavities 15 and the outside of the cylinder tail are formed on the acoustic liner 16. The rest of the structure is the same as the first embodiment.

In the gas turbine combustor of present embodiment, the cooling air is introduced into the cavities 15 from the cooling holes 18 of the acoustic liner 16, and then the cooling air is introduced into the cooling grooves 13 from the cooling holes 17. The cooling air is introduced into the cylinder tail 9 via the cooling holes 19, additionally the cooling air cools the cylinder tail 9 by the convective cooling while flowing in the cooling grooves 13.

As shown in the first embodiment, in the combustor having such a cooling mechanism, because the air in the acoustic liner 16 and the air in the sound absorption holes 14 resonate with the combustion oscillation, the combustion oscillation can be reduced. Thus operation with reduced NOx emission, and the prevention of resonance with the acoustic system can be achieved compatibly.

Figure 5:
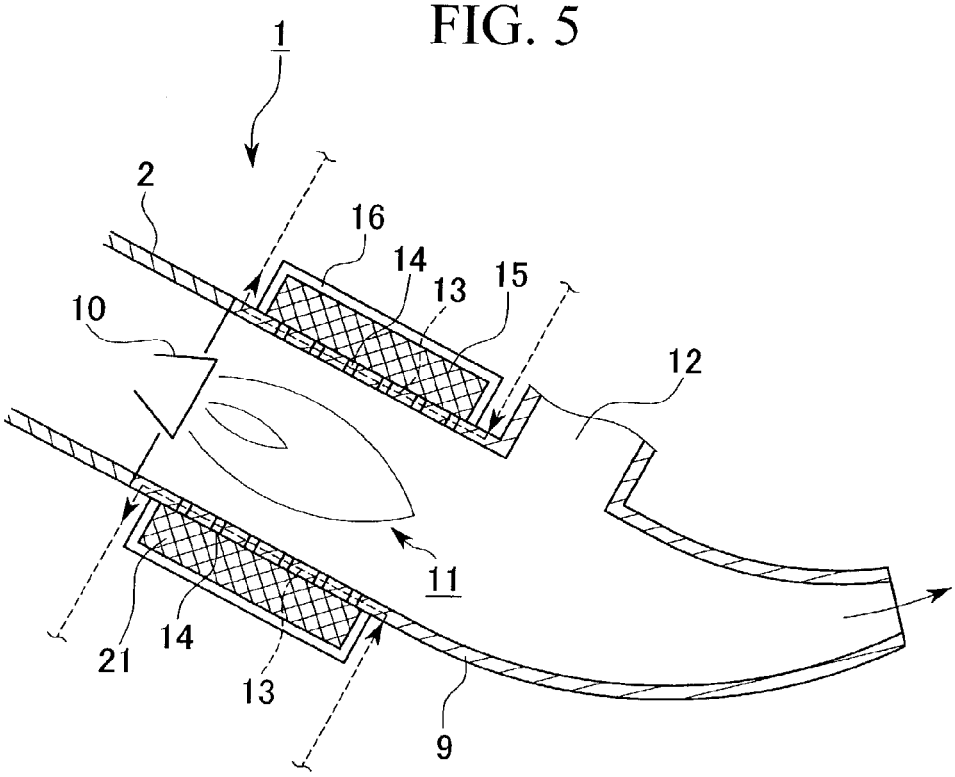
FIG. 5 is a cross section showing a resistive member formed in a hole of the acoustic liner of the third embodiment of present invention.

FIG. 5 shows the third embodiment of the gas turbine combustor of present invention. In this drawing, the same reference numerals are used for elements which are the same as those of the first embodiment in FIGS. 1 and 2 in order to avoid duplicate explanations. The second embodiment differs from the first embodiment in that a resistive member is formed on the acoustic liner 16. More specifically, in the present embodiment, as shown in FIG. 5, a sound absorbing member 21 made of porous metal such as cermet is formed in the space 15 of the acoustic liner 16.

Therefore, in present embodiment, the same effect as the first embodiment can be achieved. Furthermore, friction loss not only at the sound absorption holes 14 but also at the sound absorption member 21 occur, and the combustion oscillation can be reduced more effectively by the acoustic design of the acoustic liner 16 in view of the resistive member, and by selecting an optimal resistive member.

Also, because the sound absorption holes 14 are disposed closer to the combustion region 11, the decreasing effect of the combustion oscillation can be achieved more efficiently than in the case of above mentioned prior art disclosed in Japanese Unexamined Patent application, First publication No. Hei 6-147485.

Figure 6:
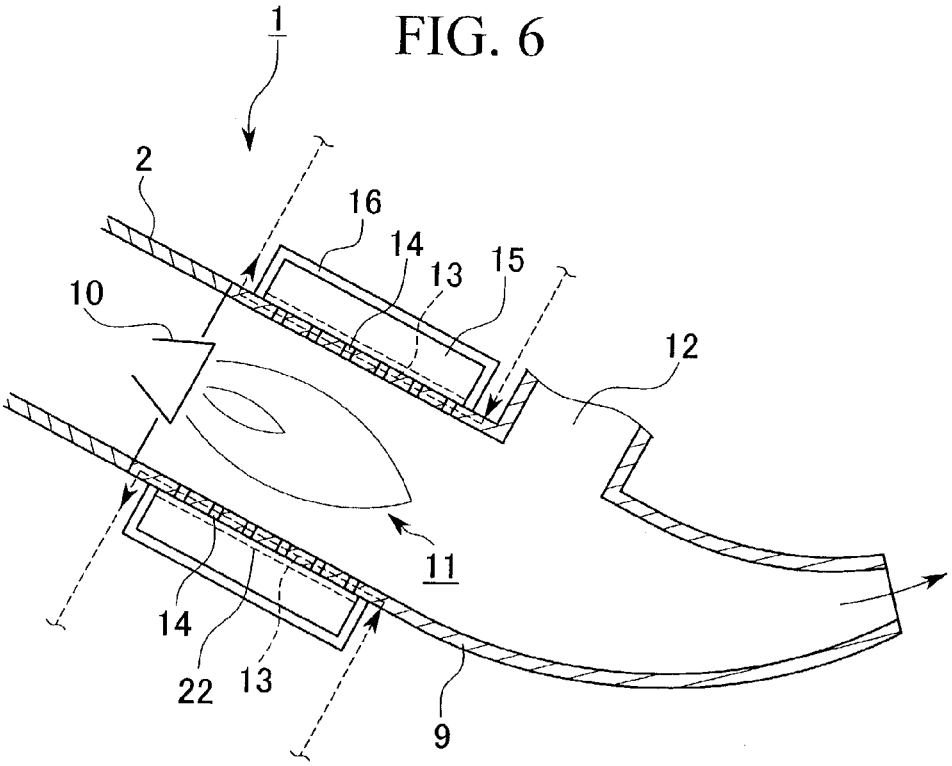
FIG. 6 is a cross section showing a resistive member formed in a hole of the acoustic liner, and a resistive member formed on the round surface of the cylinder having a sound absorption hole of another embodiment of present invention.
Figure 7:
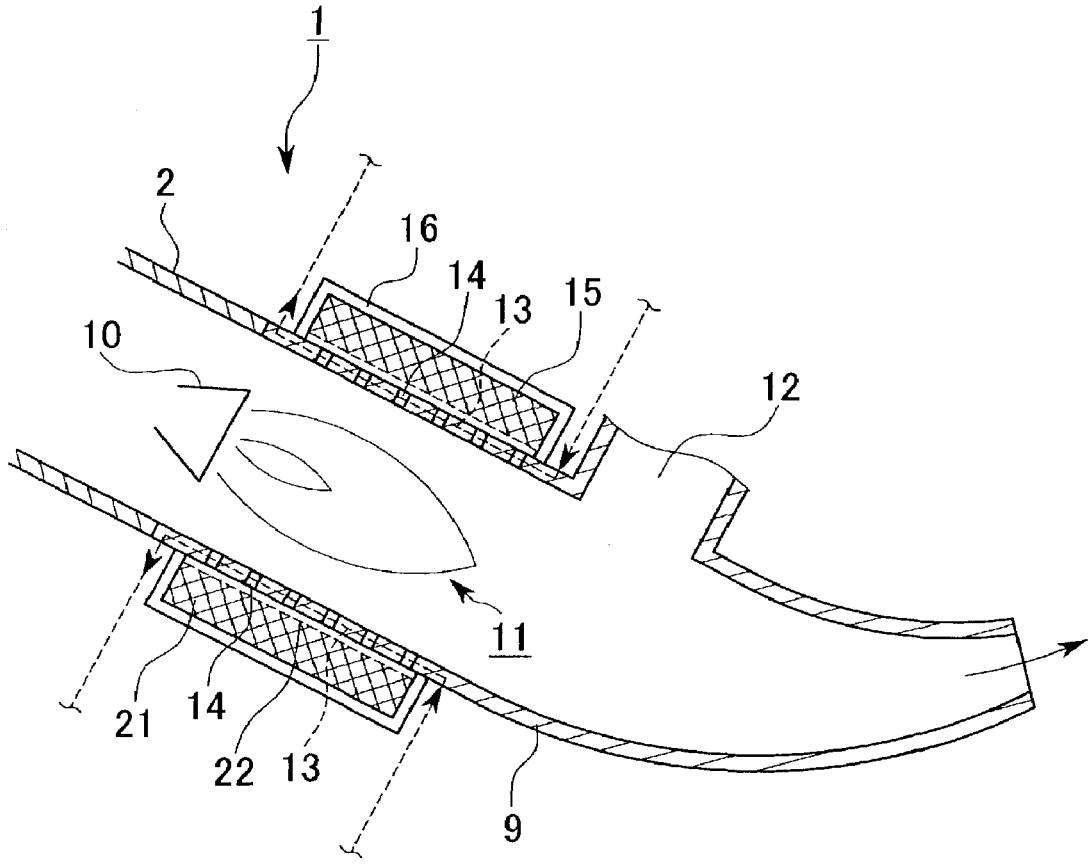
FIG. 7 is a cross section showing a resistive member formed on the round surface of the cylinder having a sound absorption hole of another embodiment of present invention.

The constitutions provided with the resistive member on the gas turbine combustor are not limited to above third embodiment. As shown in FIG. 6, a surface member 22 such as a mesh made of sintered metal may be provided as a resistive member around the cylinder 9 on which the sound absorption holes 14 are formed. The same effect as that in the third embodiment can be obtained by this constitution. Also, as shown in FIG. 7, if a sound absorption member 21 made of a porous metal as a resistive member is provided in the cavities 15 of the acoustic liner 16, and if the surface member 22 is provided around the cylinder 9 on which the sound absorption holes 14 are formed, the same effect can be achieved.

Although the sound absorption holes 14 and the acoustic liner 16 are provided on the cylinder tail 9 in above embodiment, the construction is not limited to such a case. If the combustion region 11 is disposed inside the cylinder 2, the sound absorption holes 14 and the acoustic liner 16 may be provided on this inner cylinder. Also, the shape, disposition, and constitutions of the sound absorption holes 14, cooling grooves 13, cooling holes 17 to 19 shown in the above embodiments are only examples; therefore alternate shapes and dispositions are possible.

Figure 10A:
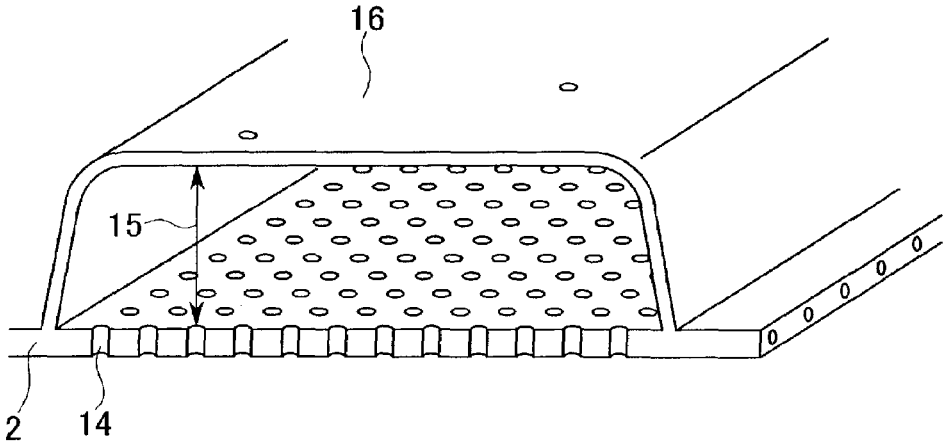
FIG. 10A is a magnified view for a structure of resonator shown in FIG. 1.
Figure 10B:
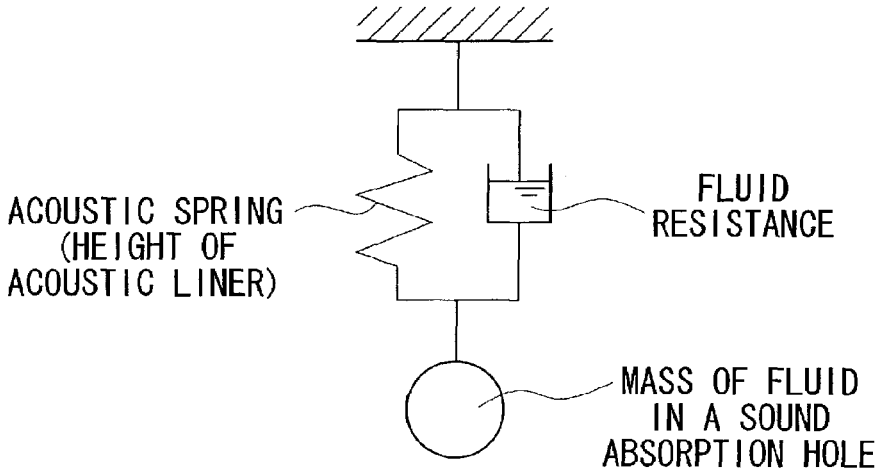
FIG. 10B shows a simplified view for explaining a theory for optimizing a fluid resistance in a sound absorption hole.
Figure 10C:
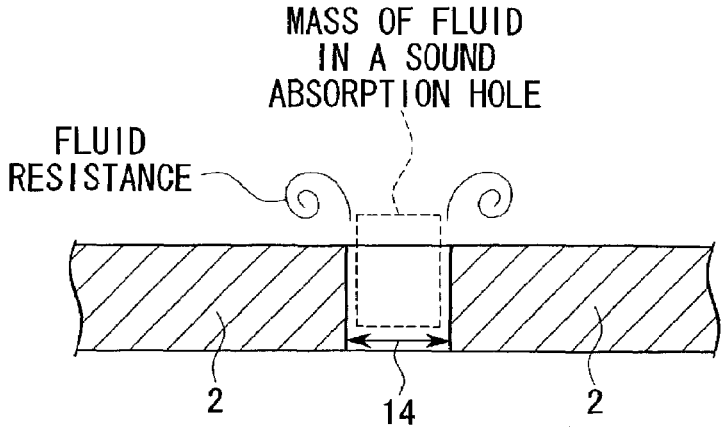
FIG. 10C shows how a fluid resistance occurs in a sound absorption hole.

FIGS. 10A to 10C are view for explaining a theory for designing an acoustic characteristics of a resonator 16 in a gas turbine combustor according to the present invention.

Figure 8:
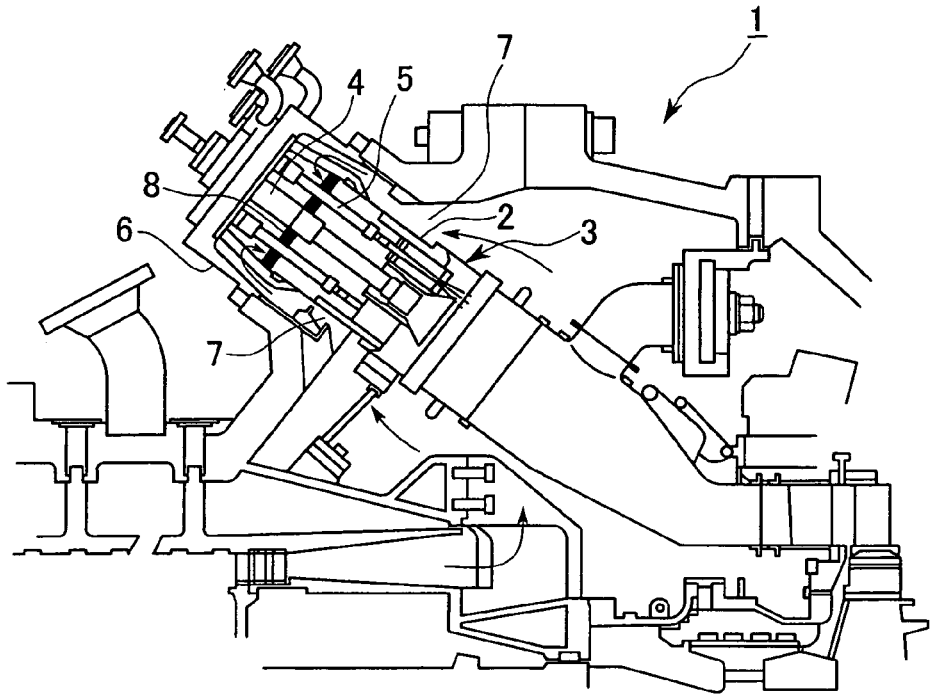
FIG. 8 (Conventional Art)
FIG. 8 is a cross section of conventional combustor.
Figure 9:
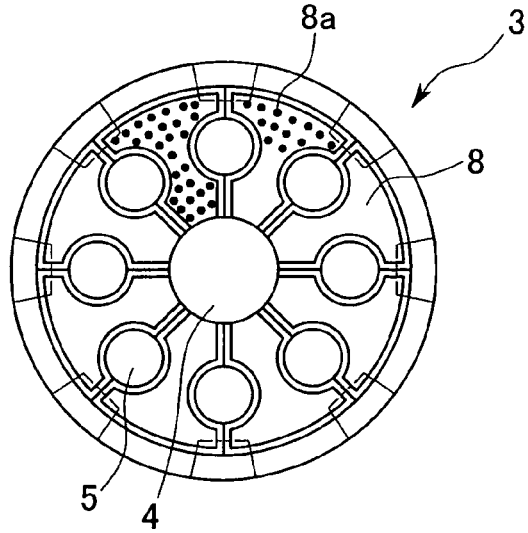
FIG. 9 (Conventional Art)
FIG. 9 is another cross section of the conventional combustor shown in FIG. 8.

In these drawings, for the purpose of simplifying the explanation, the same reference numerals are used for the elements which are the same as those of the prior art in FIGS. 8 and 9.

Acoustic characteristics in a resonator is determined by designing two factors such as a fluid resistance in a sound absorption hole 14 and a resonation frequency which is produced between an inner cylinder 2 and a resonator 16.

A resonation frequency is designed by, at first, adjusting an aperture in a sound absorption hole 14. Thus, a fluid resistance in the sound absorption hole 14 is optimized. After that, resonator 16 is designed such that a resonation frequency which is determined by an inner cylinder 2 and a resonator 16 coincides a frequency which is caused by a combustion. Such an optimization for the resonating frequency can by performed by simplifying a relationship of height of the acoustic liner resonator 16 and a resistance in the sound absorption hole 14 in the inner cylinder 2 as shown in FIG. 10B. According to FIG. 10B, it is understood that a resistance in a sound absorption hole 14 can be determined by an acoustic spring (which indicates a height 15 of the resonator 16 shown in FIG. 10A) and a fluid resistance in a sound absorption hole 14. Also, FIG. 10C shows how a fluid resistance occurs in a sound absorption hole 14.

In the present invention, frequency of vibration caused by a combustion in the gas turbine combustor is in an approximate range of 1000 Hz to 5000 Hz. The Inventors of the present invention found that it is possible to reduce a vibration caused by a combustion most effectively under condition that a diameter of a sound absorption hole in the inner cylinder 2 is approximately 1 to 3 mm and a height of the resonator is approximately 6 to 25 mm.

What is claimed is:

1. A gas turbine combustor comprising:

a cylinder having a combustion region inside of the cylinder;

a resonator having a cavity and provided around the surface of the cylinder; and sound absorption holes formed in the cylinder and having opening ends on the cylinder, wherein a diameter of a sound absorption hole in the cylinder is approximately 1 to 3 mm;

a height of the resonator is approximately 6 to 25 mm, and a plurality of fluid grooves are provided at intervals on the cylinder.

2. A gas turbine combustor according to claim 1, wherein the resonator and the sound absorption holes correspond to the natural resonance frequency of the cylinder.

3. A gas turbine combustor according to claim 1, wherein the resonator and the sound absorption holes are disposed near the combustion region.

4. A gas turbine combustor according to claim 1, wherein the sound absorption holes are formed among the fluid grooves.

5. A gas turbine combustor according to claim 1, wherein a resistive member which generates friction loss is formed in the cavity of the resonator.

6. A gas turbine combustor according to claim 5, wherein the resistive member which generates friction loss is formed around the surface of the cylinder on which the sound absorption holes are formed.

7. A gas turbine comprising:

the gas turbine combustor according to claim 1;

a compressor which compresses air and supplies a flow of air; and a turbine which expands high temperature high pressure gas supplied from the gas turbine combustor and rotates in order to generate a shaft output.

8. A jet engine comprising:

the gas turbine combustor according to claim 1;

a compressor which compresses air and supplies flow of air; and a turbine to which high temperature high pressure gas is supplied from the gas turbine combustor.

9. A gas turbine combustor according to claim 1, wherein the plurality of grooves are formed at intervals in a peripheral direction of the cylinder.

10. A gas turbine combustor according to claim 1, wherein the plurality of grooves are passages extending within a wall of the cylinder, the passages having semicircular cross-sections.

11. A gas turbine combustor according to claim 1, further comprising a cooling hole provided on the surface of the cylinder, wherein the cooling hole communicates with at least one fluid groove of the plurality of fluid grooves.

12. A gas turbine combustor according to claim 11, wherein the cooling hole is provided at an upstream location from the at least one fluid groove.

13. A gas turbine combustor according to claim 1, further comprising a cooling hole provided on an internal surface of the cylinder, wherein the cooling hole communicates with at least one fluid groove of the plurality of fluid grooves.

14. A gas turbine combustor according to claim 13, wherein the cooling hole is provided at a downstream location from the at least one fluid groove.

15. A gas turbine combustor comprising:

a cylinder having a combustion region inside of the cylinder;

a resonator having a cavity and provided around the surface of the cylinder; and sound absorption holes formed in the cylinder, wherein a plurality of fluid grooves are provided at intervals on the cylinder, and wherein the plurality of grooves are passages extending within a wall of the cylinder, the passages having semicircular cross-sections.

16. A gas turbine combustor comprising:

a cylinder having a combustion region inside of the cylinder;

a resonator having a cavity and provided around the surface of the cylinder; and sound absorption holes formed in the cylinder, wherein a plurality of fluid grooves are provided at intervals on the cylinder, wherein the plurality of grooves are passages extending within a wall of the cylinder, the passages having semicircular cross-sections, and wherein a cooling hole is provided on the cylinder, wherein the cooling hole communicates with at least one fluid groove of the plurality of fluid grooves.

17. A gas turbine combustor according to claim 16, wherein the cooling hole is provided on the surface of the cylinder at an upstream location from the at least one fluid groove.

18. A gas turbine combustor according to claim 16, wherein the cooling hole is provided on an internal surface of the cylinder at a downstream location from the at least one fluid groove.

* * * * *